United States Patent [19]

Davis

[11] 4,203,308

[45] May 20, 1980

[54] APPARATUS FOR TESTING AND STRAIGHTENING ARROW SHAFTS AND THE LIKE

[76] Inventor: Duane L. Davis, 1712 Spruce Ave., Longmont, Colo. 80501

[21] Appl. No.: 884,114

[22] Filed: Mar. 7, 1978

[51] Int. Cl.[2] ..... B21D 3/16

[52] U.S. Cl. ..... 72/34; 72/389

[58] Field of Search ..... 72/32, 34, 35, 385, 72/386, 389

[56] References Cited

U.S. PATENT DOCUMENTS

| | | | |
|---|---|---|---|
| 1,449,100 | 6/1924 | Ekstrom | 72/34 |
| 2,876,822 | 3/1959 | Groves | 72/389 |
| 3,034,385 | 5/1962 | Hester | 72/389 |
| 3,388,575 | 6/1968 | Fuzeae | 72/389 |
| 3,456,467 | 7/1969 | Hogarth | 72/389 |
| 3,846,998 | 11/1974 | Lock | 72/34 |

*Primary Examiner*—Francis S. Husar
*Assistant Examiner*—Gene P. Crosby
*Attorney, Agent, or Firm*—Young & Martin

[57] ABSTRACT

An arrow straightener for testing and straightening bent arrow shafts is provided with a pair of arrow supports, each of which has a bearing surface that is rotatable about an axis normal to a vertical plane through the longitudinal axis of an arrow positioned on the supports to maintain the bearing surface in flat contact relation to the arrow shaft, a press mechanism between the supports for applying a straightening pressure on the arrow shaft, and a deflection indicator with a feeler that extends through the press mechanism into contact with the shaft, the feeler being movable independent of the press but located at a point central to the pressure applying surface. The apparatus also includes a scale, indicator, weighted body, and spacer for testing the spine strength of wooden arrow shafts.

19 Claims, 7 Drawing Figures

APPARATUS FOR TESTING AND STRAIGHTENING ARROW SHAFTS AND THE LIKE

BACKGROUND OF THE INVENTION

The present invention relates generally to straightening and testing devices, and more particularly to an arrow straightener and testing apparatus adapted to straighten bent metallic shafts of arrows and to test the spine strength of wooden arrow shafts.

Arrow shafts used in archery can be fabricated of a variety of materials such as wood, metal, fiberglass and graphite. Metallic arrow shafts, usually either stainless steel or aluminum, often bend when they strike and ricohet off a solid object, such as a rock, target butt or wood.

Rather than disposing of bent arrows, it is often desirable to straighten them so they can be used again. Although it is possible to straighten the arrows by hand, such manual straightening usually lacks the necessary precision to obtain a shaft sufficiently straight for accuracy and desirable performance in archery shooting.

There are several devices available to assist in straightening arrow shafts and which are effective to varying extents. For example, U.S. Pat. No. 2,876,822, issued to H. Groves discloses an arrow runout tester and straightener apparatus having two spaced-apart arrow supports, press means for applying straightening pressure to the arrow, and indicator means to measure and indicate the deflection of the arrow. U.S. Pat. No. 3,846,998, issued to W. Lock discloses another variation in arrow straightener apparatus which includes two adjustably spaced-apart supports, press means for applying a straightening force, and a deflection gauge positioned alongside the press means. Each support of the lock device also includes a pair of axially rotatable bearings mounted in tandem relation to each other upon which the arrow shaft is supported and belt drive means for rotating the bearing supports about their respective axes to impart rotating motion to the arrow shafts. While these devices are effective in straightening arrows, it is not uncommon for such devices to cause crimps, dents or kinks in the arrow shaft at the point of support, particularly in situations in which the arrow is severely bent so tha it does not lay flat on the support bearing surfaces, and their deflection indicators may not be as accurate as would be desirable.

It is also customary to grade and classify wooden arrow shafts according to spine strength as indicated by a standard deflection measurement resulting from suspending a two-pound weight from the arrow shaft midway between two supports spaced 26 inches apart from each other. Therefore, it is desirable for a complete arrow service apparatus to include spine strength testing capabilities as well as straightening capabilities.

SUMMARY OF THE INVENTION

Accordingly, it is an object of the present invention to provide a novel and improved arrow straightener device which is effective for straightening most bent arrow shafts easily and conveniently and without causing crimps, dents or kinks in the arrow shaft at the contact points of the arrow shaft and the supports and of the arrow shaft and the press apparatus.

It is also an object of the present invention to provide an arrow straightener apparatus which has a pair of adjustable spaced-apart arrow supports, each of which is provided with bearing surfaces for supporting the arrow thereon which are rotatable about an axis normal to a vertical plane passing through the longitudinal axis of the arrow when supported on the bearing surface such that the bearing surface conforms to the position of the arrows in flat contacting relationship thereto.

It is a further object of the present invention to provide an arrow straightener apparatus having press means thereon for supplying a transverse straightening force to an arrow shaft and deflection measurement and indicating means having a feeler located at a point in the center of the contact surface of the press means, yet movable independently thereof.

It is still another object of the present invention to provide an arrow straightener apparatus having press means adaptable for supplying a transverse straightening force to the arrow shaft and operated by a convenient, easily controlled drive mechanism.

Still another object of the present invention is to provide an arrow straightener apparatus with associated equipment adaptable for testing the spine strength of an arrow.

The arrow straightener and testing apparatus of the present invention includes a platform having mounted thereon a pair of adjustably spaced-apart arrow supports, press means positioned between the supports, and deflection measuring and indicating means with feeler means positioned to contact the arrow shaft at a point at the center of the contact surface of the press means. Each support is provided with a pair of rotatable wheels mounted in tandem relation to each other in a mounting block, and the mounting block is supported by axles journaled in the support for rotation about an axis normal to a perpendicular plane positioned through the longitudinal axis of an arrow supported on the support means such that the arrow is supported by the combined bearing surfaces of the two rotatable wheels and the surfaces of the wheels conform to the contact surface of the arrow shaft regardless of the degree of bend in the arrow.

The press means is comprised of a horizontal arm slidably mounted on and extending horizontally from a vertical support shaft and driven by a cable fastened at one end to the horizontal arm and at the other end to a reel, which reel is turned by a convenient handle. A deflection gauge is mounted on the vertical support shaft and suspended over the horizontal arm. A feeler shaft of the deflection gauge extends downwardly through a vertical hole in the arm provided therefor through the center of the load-applying surface of the contact arm.

A scale is provided on the platform to accommodate adjustably setting the supports a spaced distance of 13 inches apart from each other, and a weighted body with suspension means and spacer means for maintaining the weighted body in suspension from the shaft a distance of 13 inches outwardly of one of the bearing supports is provided for testing the spine strength of the arrow. The deflection gauge, acting independently of the press means, indicates the deflection in the arrow shaft caused by the suspension of the weighted body from the arrow shaft.

BRIEF DESCRIPTION OF THE DRAWINGS

Other objects, advantages and capabilities of the present invention will become more apparent as the description proceeds taken in conjunction with the accompanying drawings, in which.

DETAILED DESCRIPTION OF THE PREFERRED EMBODIMENT

Figure 1:
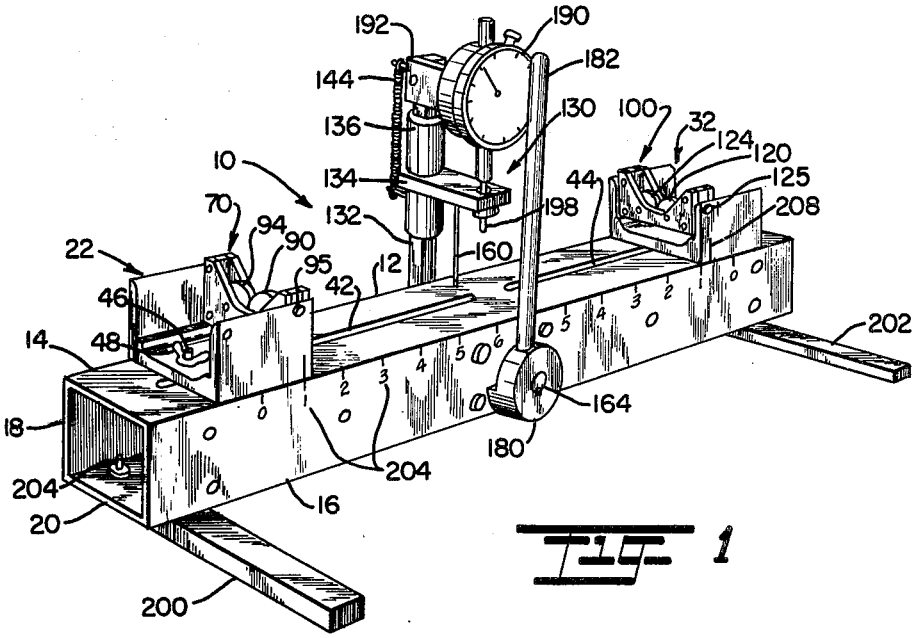
FIG. 1 is a perspective view of the arrow straightener device.
Figure 4:
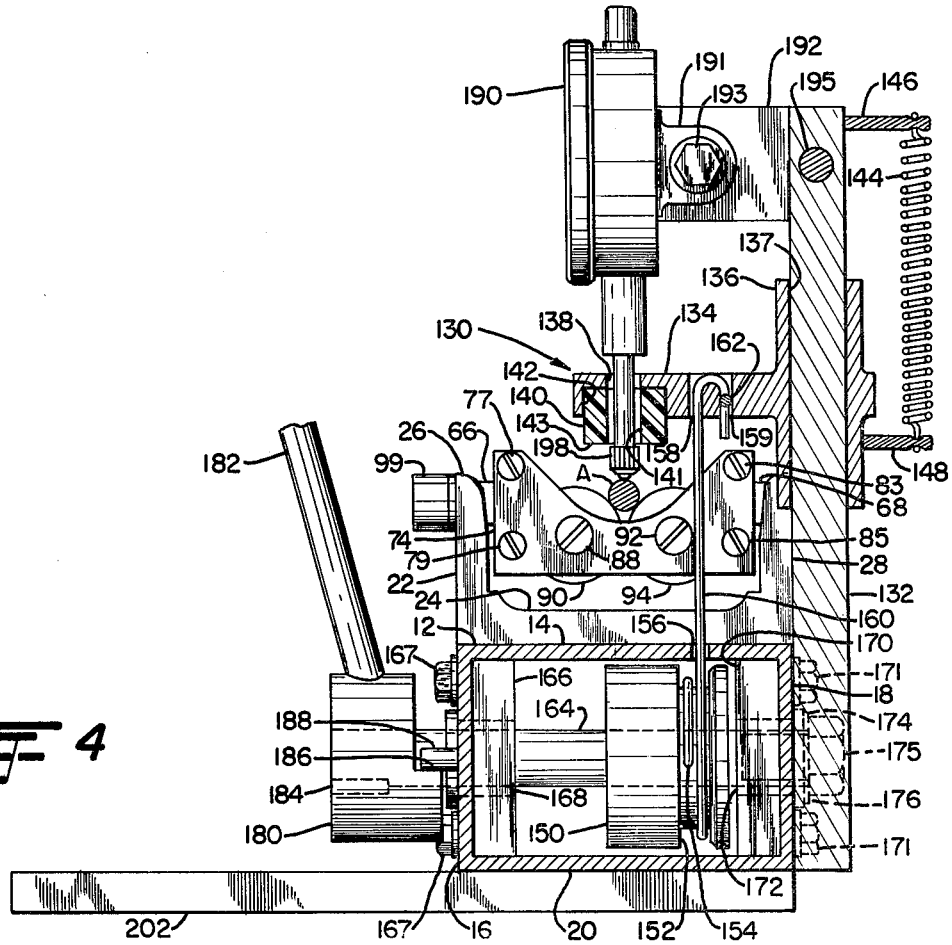
FIG. 4 is a cross-sectional view taken along the lines 4—4 of FIG. 3.
Figure 2:
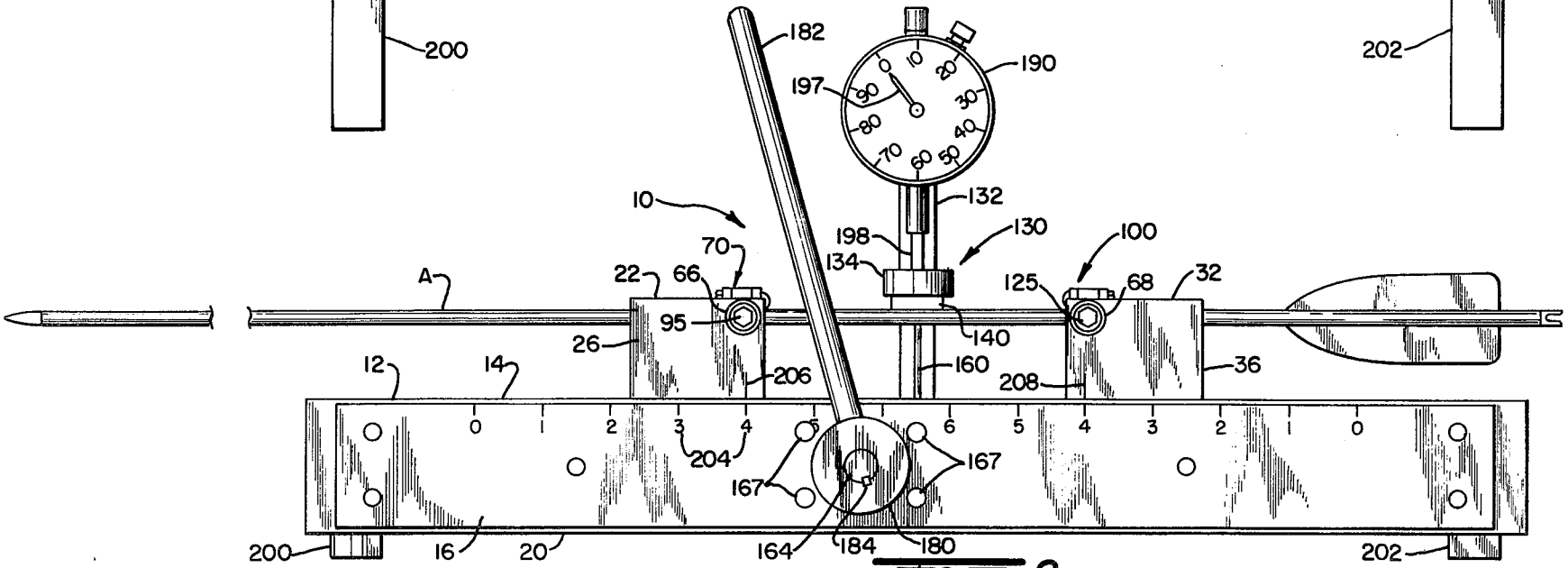
FIG. 2 is an elevation view of the arrow straightener device with an arrow supported thereon for straightening.
Figure 5:
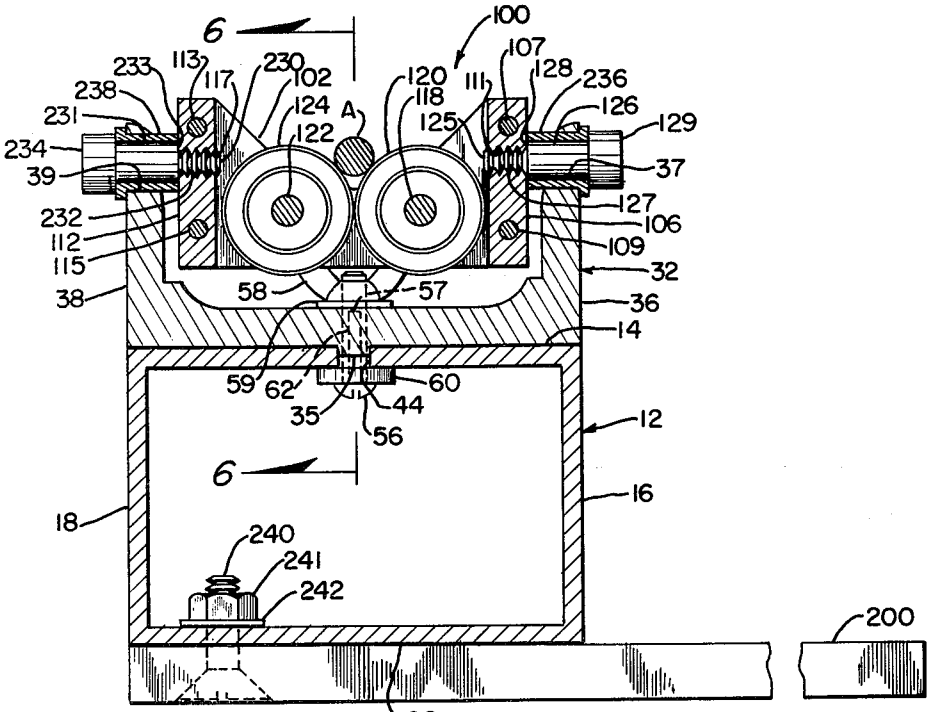
FIG. 5 is a cross-sectional view taken along lines 5—5 of FIG. 3.

An arrow straightener device 10 in accordance with the present invention is shown in FIG. 1. It is comprised of an elongated tubular platform or base 12 of rectangular cross-section having a flat top surface 14, a flat front surface 16, a rear flat surface 18, and a bottom flat surface 20. A pair of bearing cradles or carriages 22, 32 are slidably mounted on the top surface 14 of the platform base 12 and are adjustably movable toward and away from each other. A pair of rotatable wheels or bearings 90, 94 are rotatably mounted on parallel axes in side-by-side tandem relation to each other in the left bearing cradle 22, and similar wheels or bearings 120, 124 are likewise mounted in tandem in the right bearing cradle 32. An arrow A which is to be straightened with the device 10 is supported on the device by adjacent peripheral surfaces of the rotatable bearings as illustrated in FIGS. 2, 4 and 5.

The straightener device 10 also includes a press 130 spaced above the top surface 14 of platform 12 and between the bearing cradles 22, 32. The press is movable vertically to apply a straightening pressure on the arrow shaft A normal to the longitudinal axis of the arrow as it is supported by the bearings. The press 130 is manually operated by the handle 182 as will be described more fully herein.

The straightener device 10 also includes a deflection gauge 190 positioned over the press 130 for detecting, measuring and indicating the extent of deflection of the arrow shaft A.

Two elongated bars 200, 202 extend horizontally and transversely outward from the bottom surface 20 of the platform 12 to provide a widened base for additional support of the straightener device 10 as it is being used to straighten arrows. Each is fastened to the bottom surface 20 of the platform 12 by countersunk bolts 240 secured therein by nuts 241 and lock washers 242, as illustrated in FIG. 5.

The press 130, as best seen in FIG. 4, is comprised of a horizontal arm 134 slidably mounted on a vertical shaft 132. The vertical shaft has a square cross section and is affixed to the rear wall 18 of platform 12. The press arm 134 extends horizontally from a vertical sleeve 136 having a square bore 137 extending vertically therethrough of a size corresponding to the external dimensions of the shaft 132. The shaft 132 extends through the bore 137, and sleeve 136 is slidable up and down on the shaft 132. An elongated sleeve 136 is desirable as illustrated to provide sufficient bearing surface between the inside surface of the sleeve 136 and the outside surface of the shaft 132 to minimize or eliminate any adverse binding effects therebetween caused by force couples. Movement of the arm 134 is thereby enhanced by smooth gliding up and down of the sleeve 136 on the shaft 132. The square shape of the shaft 132 and corresponding shape of bore 137 are effective to prevent the sleeve 136 and arm 134 from rotating around the shaft. Of course, other structures such as a round shaft and sleeve bore including a key and elongated keyway could be used to obtain the desired structural assembly and resulting functional characteristics.

An upper anchor pin 146 extends horizontally rearwardly from the top of shaft 132. A lower anchor pin 138 extends horizontally rearwardly from the sleeve 136. A tension spring 144 attached at one end to the upper anchor pin 146 and at the other end to lower anchor pin 138 is effective to normally bias the sleeve 136 and press arm 134 upwardly.

The drive mechanism for the press is also best illustrated in FIG. 4 wherein a spool 150 having an annular groove 152 in its peripheral surface is shown mounted on and keyed to a shaft 164 extending transversely through the platform 12. The shaft 164 is journaled in bushing block 166 at the front of platform 12 and in bushing block 170 at the rear of platform 12. A front bushing 168 extends through the front panel 16 and bushing block 166 to minimize rotational friction and withstand the wear resulting from rotation of the shaft 164. A similar rear bushing 172 extends through the rear panel 18 of the platform 12 and through rear bushing block 170 to likewise reduce friction and withstand the wear resulting from the rotating shaft and the forces thereon.

Front bushing block 156 is affixed to the front panel 16 by machine bolts 167 which extend through the front panel 16 and are threaded into the bushing block 166. Likewise, rear bushing block 170 is affixed to rear panel 18 by machine bolts 171 which extend through rear panel 18 and are threaded into bushing block 170. An internally threaded hole extends axially into shaft 164 from its rear end, and bolt 174 is screwed into the shaft and tightened with its head 175 and a washer 176 against the rear end of the shaft 164 to prevent axial sliding of the shaft 164 during straightening operations.

The front end of the shaft 164 extends outwardly of the front panel 16 of platform 12, and a crank hub 180 is mounted thereon and keyed to the shaft 164 by key 184. Handle 182 is affixed to and extends radially from the peripheral surface of the crank hub 180 for manually rotating shaft 164 and spool 150.

A stop shoulder 186 extends axially inward from the inside surface of hub 180 toward the front panel 16 of platform 12. A limit stop pin 188 is affixed to and extends outwardly from the front panel 16 into alignment with stop shoulder 186, and thereby limits the rotation of the shaft 164 against the bias of spring 144.

A flexible cable 160 extends between the horizontal press arm 134 and spool 150. It passes through hole 156 in the top panel 14 of platform 12. The upper end of cable 160 extends upwardly through hole 158 in press arm 134 and then returns downwardly through hole 159, and it is secured therein by the set screw 162 threaded into the side of press arm 134 in alignment with the downwardly extending end of cable 160. The lower end of the cable 160 is wrapped around groove 152 in spool 150 and secured to spool 150 by insertion of its end into hole 154 in groove 152. It can be appreciated therefore that rotation of shaft 164 by manually operating the handle 182 causes the cable 160 to be wound farther around spool 150 thereby pulling press arm 134 downwardly against the upward bias of spring 134. As soon as manual force is released from handle 182, the bias of spring 144 causes press arm 134 to move upwardly thereby unwinding the cable 160 from the spool 150 until stop shoulder 186 rotates into contact with limit stop pin 188 to prohibit any further upward movement of the press arm 134.

Press arm 134 is provided with a pressure applying surface 143 on its bottom side near its distal end in vertical alignment with an arrow shaft A properly positioned on the bearing surfaces as described above. When the press arm 134 is pulled downwardly by operation of handle 182 as described above, it contacts the arrow A and applies a straightening force thereto transverse to the longitudinal axis of the arrow shaft A. The pressure applying surface 143 is preferably fabricated of a somewhat resilient yet tough material such as the urethane sleeve 140 illustrated in FIG. 4 inserted into a bore 142 extending upwardly into the distal end of press arm 134. It has been determined that a urethane sleeve having Shore A scale durometer hardness of 95 provides the desired characteristics. A pressure applying surface 143 having these characteristics is effective to apply a sufficient straightening force to the arrow shaft A yet minimizes or eliminates the risk of denting, crimping or otherwise damaging the peripheral surface of the arrow shaft A.

Figure 3:
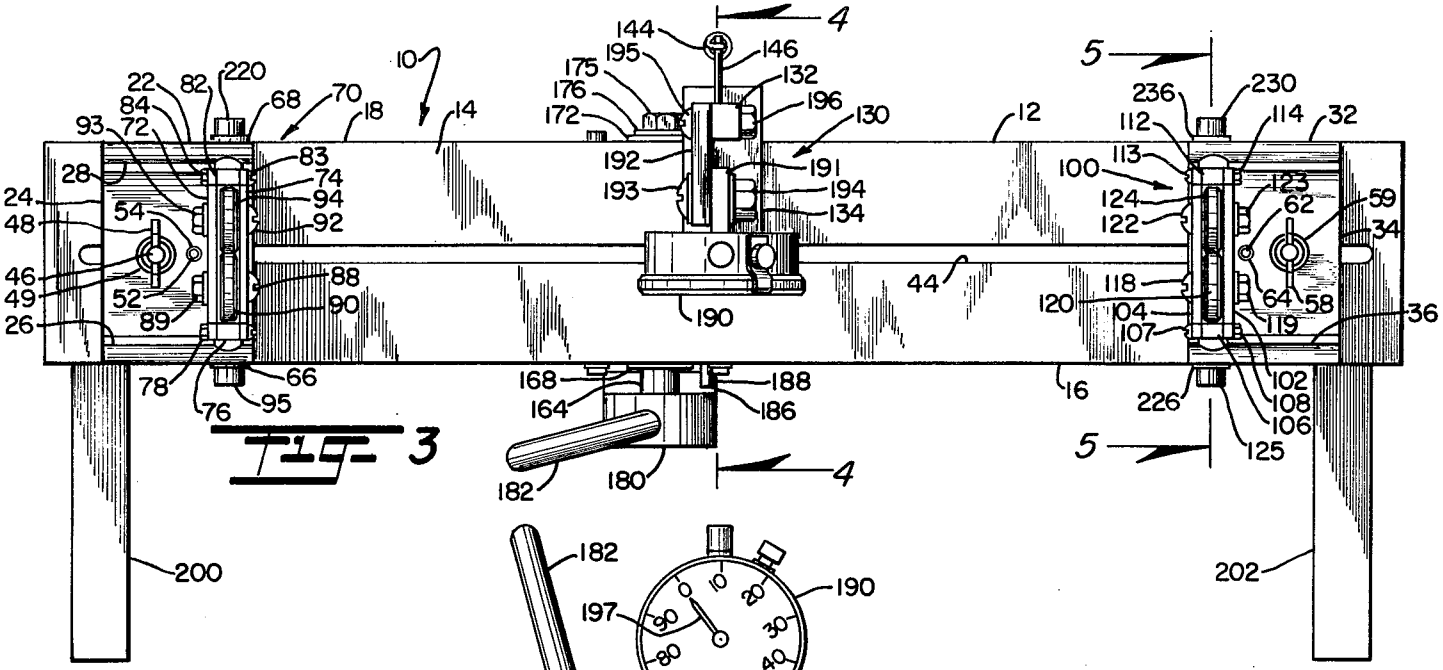
FIG. 3 is a plan view of the arrow straightener apparatus.

A significant feature of the straightener device 10 of the present invention is the manner in which the press is capable of straightening an arrow shaft while the gauge simultaneously senses misalignment through the feeler shaft or plunger 198 at the centroid of the straightening pressure. The position and resulting function of the deflection gauge 190 with feeler shaft 198 is best seen in FIG. 4. A deflection gauge 190 itself is conventional and usually includes some type of mounting gear 191 extending from its back surface, and it has a longitudinally movable, spring-biased feeler shaft or finger 198 extending downwardly from its peripheral surface. The straightener device 10 of the present invention is provided with a mounting bracket 192 extending horizontally forward from the upper end of shaft 132 and secured thereto by bolt 195 and nut 196. Mounting ear 191 of the deflection gauge 190 is secured to bracket 192 by bolt 193 and nut 194, as also shown in FIG. 3, such that the feeler shaft 198 is in vertical alignment with an arrow shaft A properly positioned on the bearing surfaces in the cradles 22, 32.

A vertical hole 138 is provided in press arm 134 in alignment with the bore 141 of sleeve 140 and in vertical alignment with the arrow shaft A. Feeler shaft or finger 198 of deflection gauge 190 extends downwardly through the hole 138 and sleeve 140, thereby positioning the feeler shaft 198 in the center of the pressure applying surface 143. However, it is significant that the hole 138 and inside 141 of sleeve 140 are large enough to allow completely independent vertical movement of press arm 134 in relation to feeler shaft 198.

Such positioning and independent movement of the pressure applying surface 143 and feeler shaft 198 results in extremely accurate measurement of deflection of the arrow shaft A at the centroid of the straightening force applied to the arrow shaft A by press 130 while the movement of press 130 does not interfere or effect in any way the independent movement and measurement accomplished by the feeler shaft 198 of deflection gauge 190. For example, FIG. 2 illustrates press arm 134 applying a straightening force to the arrow A with the feeler shaft 198 of deflection gauge 190 in independent contact with the arrow shaft A so that the indicator needle 197 can accurately indicate the deflection of the arrow shaft. FIG. 4, however, illustrates the press arm 134 in a position over the arrow shaft A, not in contact therewith, while the feeler shaft 198 of the deflection gauge remains in independent contact with the arrow shaft A for a continuous unhibited measurement of deflection.

Another significant feature of the straightener device 10 of the present invention is the swivelled or rocking mounting of the bearing support surfaces in cradles 22, 32 so that the bearing surfaces will align themselves to establish optimum flat interfacing contact between the bearing surfaces and the shaft of the arrow, regardless of the degree of bend in the arrow shaft throughout the straightening operation. Referring primarily to FIGS. 3 and 4, the left bearing cradle 22 is in the form of an upwardly opening channel comprised of a flat bottom plate 24 positioned on the top surface 14 of platform 12, and a front upright plate 26 and rear upright plate 28 extending upwardly from bottom plate 24 in spaced-apart relation to each other. Two rotatable wheels or ball bearings, 90, 94 are positioned in closely spaced, tandem relation to each other between the front upright plate 26 and rear upright plate 28 for supporting the arrow shaft A.

The bearings 90, 94, each having a flat outer peripheral surface, are mounted for rotation on parallel axes in a bearing block 70. Bearing block 70 is comprised of a first mounting plate 72 and second mounting plate 74 in parallel, spaced-apart relation to each other with first spacer bar 76 and second spacer bar 82 positioned between the first and second mounting plates. The first and second spacer bars 76, 82 are positioned respectively at opposite ends of the first and second mounting plates 72, 74 to form the bearing block 70 and are secured together by bolts 77, 79 and nuts 78, 80 through the first spacer bar and by bolts 83, 85 and nuts 84, 86 through the second spacer bar 82. The bearings 90, 94 are rotatably mounted in side-by-side tandem relation to each other between the first and second mounting plates 72, 74 on respective parallel first and second bearing axle bolts 88, 92 and nuts 89, 93.

The assembly of the bearing block 70 and bearings 90, 94 is rotatably mounted to swivel in the bearing cradle 22 on first and second swivel axle bolts 95, 220. First swivel axle bolt 95 extends through a bushing 66 in first upright plate 26 into first spacer bar 76, and second swivel axle bolt 220 extends through bushing 68 in rear upright plate 28 into second spacer bar 82.

Figure 6:
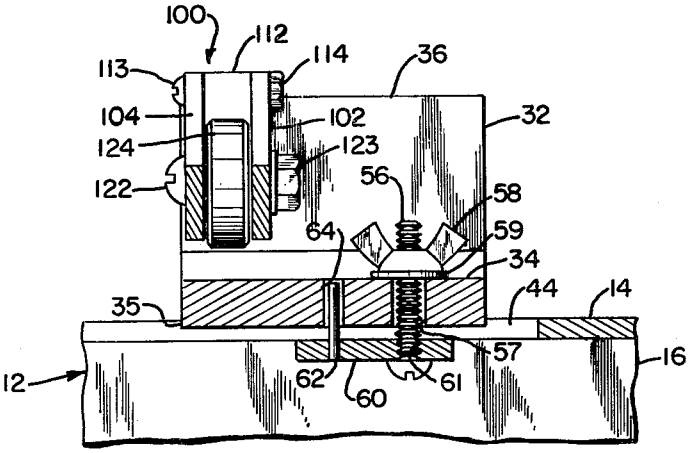
FIG. 6 is a cross-sectional view taken along lines 6—6 of FIG. 5.

The specific structure, assembly and mounting of bearing block 70 in cradle 22 is substantially the same as the structure, assembly and mounting of right bearing block 100 in right cradle 32, which is illustrated in more detail in FIGS. 5 and 6. Like the left arrow support described above, the right arrow support is comprised of two rotatable wheels or ball bearings 120, 124, rotatably mounted in side-by-side tandem relation to each other in a bearing block 100. The bearing block 100 is rotatably mounted in bearing cradle 32.

The bearing cradle 32 includes a flat bottom plate 34 positioned on the flat top surface 14 of platform 12, and a front upright plate 36 and rear upright plate 38 extend upwardly therefrom in spaced-apart parallel relation to each other. Bearing block 100 is comprised of parallel spaced-apart mounting plates 102, 104 with spacer blocks 106, 112 positioned therebetween at opposite ends thereof. The bearing block 100 is assembled and secured together by bolts 107, 109 and nuts 108, 110 through first spacer block 106, and by bolts 113, 115 and nuts 114, 116 through second spacer bar 112.

The bearings 120, 124, each having a flat outer peripheral surface, are rotatably mounted on parallel bearing axle bolts 118, 122 extending through first and second mounting plates 102, 104 and secured therein by respective nuts 119, 123.

The assembly of the bearing block 100 and bearings 118, 122 is rotatably mounted in bearing cradle 32 between the front and rear upright plates 36, 38. As best seen in FIG. 5, the front vertical plate 36 is provided with a transverse hole 37 therethrough. The rear vertical plate 38 is also provided with a similar transverse hole 39 therethrough in axial alignment with the hole 37 in front plate 36. Bushing 236 is positioned in hole 37, and a similar bushing 238 is positioned in hole 39. First spacer bar 106 has a transverse, internally threaded hole 111 extending transversely therethrough, and second spacer bar 112 also has a similar internally threaded hole 117 extending transversely therethrough in axial alignment with hole 111 and spaced upwardly from bearing axle bolts 118, 122. A first swivel axle bolt 125 is inserted through bushing 236 and screwed into hole 111. Similarly, a second swivel axle bolt 230 is inserted through second bushing 238 and screwed into hole 117. The bearing block 100 is thereby mounted or suspended in bearing cradle 32 on the first and second swivel axle bolts 125, 230.

First swivel axle bolt 125 is provided with a threaded portion 127 at its forward end of the same diameter as hole 111, a head 129 at its rear end, and an enlarged shaft portion 126 between the threaded portion 127 and head 129. The enlarged shaft portion 126 is larger in diameter than the threaded portion 127 and corresponds to the internal size of the bushing 236. An annular shoulder 128 is thereby provided at the forward end of the enlarged shaft portion 126, and the enlarged shaft portion 126 is slightly longer than the bushing 236. It can be appreciated therefore that the swivel axle bolt 125 can be screwed into hole 111 and secured therein by tightening shoulder 128 in snug abutment against the external surface of spacer bar 106 without tightening head 129 against the end of bushing 236. In this manner, the rocker axle bolt 125 is snugly secured to the axle block 100 without interfering with free rotation of the swivel axle bolt 125 in bushing 236.

The second swivel axle bolt 230 is likewise provided with a threaded forward end portion 232, a head 234 at its rear end, and an enlarged shaft portion 231 between the head 234 and the threaded portion 232. Thus the swivel axle bolt 230 can also be screwed into hole 117 and secured therein by tightening shoulder 233 against the external surface of spacer bar 112 while allowing free and unhibited rotation of the rocker axle bolt 230 within bushing 238.

With the bearing block 100 thus rotatably mounted to swivel in the bearing cradle 32 on an axis normal to a vertical plane extending through the longitudinal axis of the arrow A, the bearings 118, 122 can be swiveled back and forth in a vertical arc. Such freely swiveling motion allows the flat peripheral surfaces of the bearings 120, 124 to always conform to and remain in flush interfacing relation to the arrow shaft A in a line contact rather than a point contact, regardless of the degree of bend in the arrow shaft. This feature minimizes the risk of denting, crimping or otherwise damaging the peripheral surface of arrow shaft A when straightening pressure is applied by press 130 and as the arrow is supported by the peripheral surface of the bearings. For example, when a perfectly straight arrow shaft A is positioned on the straightener device 10, the bearings 90, 94 and 120, 124 would be positioned vertically so that their peripheral surfaces would be horizontal to conform to the horizontal position of the arrow shaft A with a line contact therebetween. However, if a bent or bowed arrow is positioned on the straightener device 10, the bearings 90, 94 and 120, 124 would be swiveled or swung to some angle from vertical so that their peripheral surfaces would still conform in flat interfacing relation to the peripheral surface of the arrow shaft A in line contact therewith. Thus the arrow shaft A is always supported in flat interfacing relation with the peripheral surfaces of the bearings rather than on the peripheral edges of the bearings as they would if the bearings were always in absolute vertical orientation on absolute horizontal axes.

As described above, the left and right bearing cradles 22, 32 are slidably mounted on the platform 12. Therefore, they can be adjusted toward and away from each other to vary the distance between the arrow supporting bearing surfaces and the press, depending on the optimum position as determined by the operator for straightening any particular bend in the arrow shaft. As best seen in FIGS. 3, 5 and 6, the platform 12 is provided with two longitudinal slotted holes 42, 44 in its top surface 14. The bottom plates 24, 34, respectively, of the left and right bearing cradles 22, 32 are each provided with downwardly protruding longitudinal ribs 35 which are inserted into and glide in the slotted holes 42, 44. The rib 35 therefore maintains the bearing cradle in proper alignment with the opposite bearing cradle and with the press and deflection gauge feeler shaft. The right bearing cradle 32 is also secured to the top surface 14 of the platform 12 by a tightener bolt 56 which extends upwardly through the slotted hole 44 and through a vertical hole 57 in the bottom plate 34. A washer 59 is inserted over the bolt 56 and a wing nut 58 is screwed thereon for tightening.

In order to prevent the bolt 56 from turning along with the wing nut 58 as it is being tightened as well as to provide a larger bearing surface under the bolt head to span the slotted hole 44, a keeper plate 60 with a threaded hole 61 therethrough is threaded onto the bolt 56 and snugged against the bolt head. The keeper plate 60 is elongated and at its distal end has keeper pin 62 extending upwardly therefrom through the slotted hole 44 and into a hole 64 provided for that purpose in the bottom plate 34. Therefore as the wing nut 58 is being turned to tighten the bolt 56, the keeper pin 62 engaged in hole 64 prevents the bolt 56 from also turning along with the nut 58.

Of course, the left bearing cradle 22 is also provided with a similar tightener bolt 46, washer 49, wing nut 48 and keeper plate (not shown) with keeper pin 52 and corresponding hole 54 in bottom plate 24 that are structured and function the same as described for the right bearing cradle assembly. It can be appreciated therefore that the left and right bearing support surfaces for supporting the arrow thereon can be adjustably set and secured at any desired position on the top surface 14 of platform 12.

A bent arrow shaft A can be straightened with the straightener apparatus 10 of the present invention by positioning the arrow under the press arm 134 and supporting it in that position with the bearings or wheels 90, 94 and 120, 124 as described. The bearing cradles 22, 32 can be adjustably moved toward and away from each other depending on the nature of the bend in the arrow and the desire of the operator to support the arrow in an optimum position for straightening the bend. For example the supports typically are set closer together for sharp bends and farther apart for longer gentle bends. A straightening force is then applied on the arrow by drawing the press arm downwardly onto the arrow and forcing it transversely against the bent arrow. When the pressure of the press is released, the feeler shaft 198 will remain in contact with the arrow shaft, and the arrow shaft can be axially rotated manually under the feeler shaft. The axially rotatable wheels or bearings 90, 94 and 120, 124 of the left and right supports accommodate such rotation of the arrow shaft and rotate along therewith. As the arrow shaft is rotated, the feeler shaft 128 will detect any bend in the arrow shaft and will cause a visual indication of the bend by causing corresponding movement of the indicator needle 197 on the deflection gauge 190. When a perfectly straight arrow shaft is so rotated under the feeler shaft, the indicator needle will not move.

Figure 7:
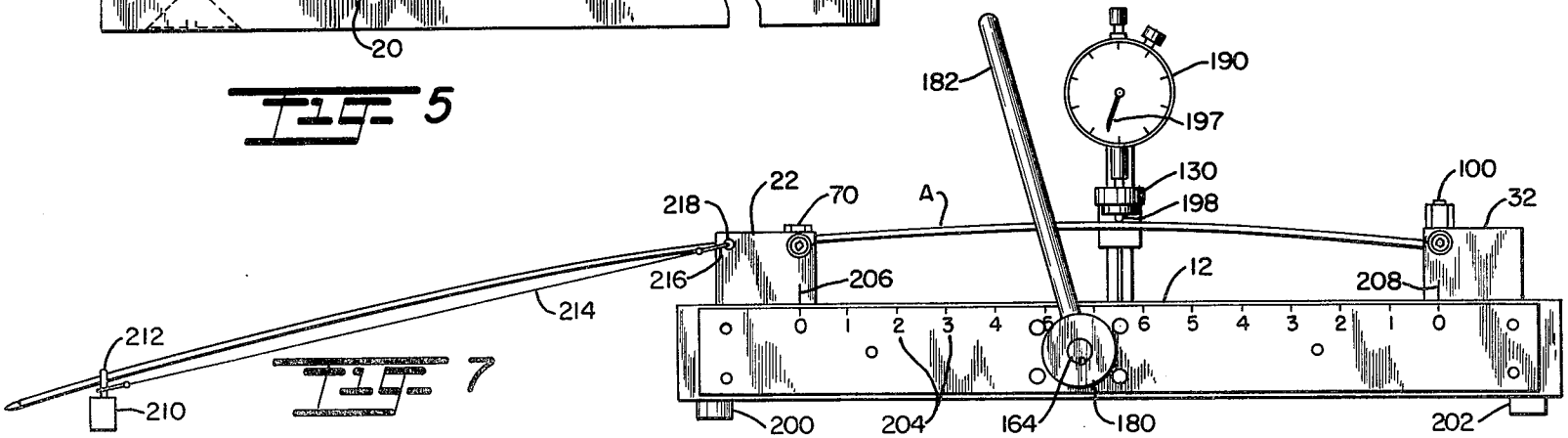
FIG. 7 is an elevation view of the device as used for testing the spine strength of an arrow.

Another important feature of the present invention, which is accommodated by the adjustably slidable bearing cradles 22, 32 and the rocking or rotatable bearing block mounting therein, is a test apparatus for testing the spine strength of wooden arrow shafts. The standard spine strengths of wooden arrows are tested and designated by the amount of deflection of the arrow shafts from a straight longitudinal axis resulting from suspending a two-pound weight from the arrow shafts halfway between a pair of arrow supports that are spaced 26 inches apart. The straightener device of the present invention can also be used to determine the spine strength of arrows by measuring deflection as shown in FIG. 7 and converting the deflection into standard arrow test deflection units, as will be described more fully herein.

The straightener device 10 of the present invention is also provided with a scale along the front upper edge of the platform 12 with indicia 204 thereon graduated in one-inch distances. The distance between the indicia labeled zero on the left end and the indicia on the right end labeled zero is exactly 13 inches, which is one-half of the 26 inches conventionally used in a standard test. Each bearing cradle 22, 32 is provided with an indicator mark 206, 208, respectively, exactly aligned with the bearing blocks 70, 100, respectively. Therefore, when the left bearing cradle 22 is adjusted as described above so that its marker 206 is aligned with the left zero indicia, and the right bearing cradle 32 is adjusted and secured with its marker 208 in exact alignment with the right zero indicia, the respective blocks 70, 100 will be spaced exactly 13 inches apart with the feeler shaft 198 of the deflection indicator 190 precisely at midpoint between the bearing blocks 70, 100.

A weighted body 210 of predetermined standard weight having a suspension hook 212 thereon for suspending the weighted body 210 from an arrow shaft A is provided with a guide retainer cord 214 attached at one end to the weighted body and provided at its free end with a hook 216. A hole 218 is provided through the front plate of bearing cradle 22 to accommodate attachment of the hook 216 therein, and the cord 214 is of a length such that when it is fully extended the weighted body will be suspended from the arrow shaft A a distance of exactly 13 inches outwardly from the bearing block 70. Since the gravitational force of the weighted body acting on the arrow shaft A tends to rotate the shaft counterclockwise about an axis through the bearing block 70, the right end of the arrow shaft A is restrained against such rotation by rotating bearing block 100 about its axis 180 degrees to its upside down position and placing the right end of the arrow shaft A in flat interfacing contact with the peripheral surfaces of the bearings 120, 124 in bearing block 100, as shown in FIG. 7.

Before the weighted body 210 is suspended from the arrow shaft A, the arrow shaft A should be substantially straight and supported in its center by bearings 90, 94 in bearing block 70. The right end can be manually held against the peripheral surfaces of bearings 120, 124 in their upside down position as described above with the feeler shaft 198 of deflection indicator 190 in contact with the arrow shaft A. The scale on the deflection indicator can be adjusted in the conventional manner so that its zero indicia is in alignment with the indicator needle 197. Then, with the hook 216 engaged with hole 218, and the cord 214 extended taut, the weighted body 210 can be suspended from the left end of the arrow shaft. The gravitational force of the weighted body acting on the arrow shaft will cause it to bow as indicated in FIG. 7, the the deflection of the arrow shaft at a point midway between the bearing blocks 70, 100 will be measured and indicated by the deflection indicator 190. The deflection indicator reading can then be converted to a standard spine strength deflection either by calculation, or preferably, by use of a conversion table. Such a conversion table can be prepared empirically by testing a series of arrows of varying spine strengths both with the standard method of suspending a one-pound weight between two supports 26 inches apart to obtain the standard deflection and then testing the same arrows with the device of this invention to obtain the corresponding deflection for tests conducted with the straightener and testing device as described above. The respective test results can be compiled in a table or chart and used as a convenience for converting spine test results from the present invention to standard test deflection units.

Although the present invention has been described with a certain degree of particularity, it is understood that the present disclosure has been made by way of example and that changes in details of structure may be made without departing from the spirit thereof.

What is claimed is:

1. In arrow straightener apparatus having press means adapted to apply a pressure on the shaft of an arrow in a direction normal to the longitudinal axis of said shaft and in a direction to straighten said shaft, and deflection indicator means in proximity to said press means for measuring and indicating the deviation of the arrow shaft from its normally straight longitudinal axis, the improvement comprising:

a pair of arrow supports in axially spaced-apart relation to each other, each of said supports including a a pair of bearings with circular cylindrical peripheral surfaces mounted in tandem in a mounting block on respective axes parallel to each other and to a vertical plane extending through both of said supports between said bearings in each of said supports, the peripheral surfaces of said bearings being adapted to support the arrow shaft during straightening operation, and said mounting block being adapted to swivel about an axis normal to said vertical plane to permit said bearing peripheral surfaces to be aligned flush with the surface of said arrow shaft.

2. In the apparatus of claim 1, wherein said bearing axes are lower than said block axis when in normal position for supporting an arrow shaft thereon.

3. In the apparatus of claim 3, wherein said bearings are of a predetermined diameter and said bearing axes are located a selected distance below said block axis such that the longitudinal axis of a common arrow shaft positioned on and supported by said bearing peripheral surfaces approximately intersects said block axis at right angles.

4. In the apparatus of claim 1, including an elongated tubular frame member, each of said supports includes a U-shaped channel with two spaced-apart vertical members extending upwardly from opposite sides of a cross member and adjustably mounted on said frame member and secured thereon by releasable securing means, and said block is rotatably mounted between said vertical members by a first axle extending through one of said vertical members and into one end of said block and a second axle extending through the other vertical member and into the other end of said block.

5. In the apparatus of claim 4, wherein each of said block axles is a bolt having a threaded forward end portion, a shank portion of a diameter larger than the diameter of the threaded forward end portion, with an annular shoulder at the juncture of said threaded forward end and said enlarged shank portion, and an enlarged head, said bolt being inserted through a hole in said vertical member with said head in abutment therewith and said forward threaded end portion being screwed into an internally threaded hole in the end of said block until said annular shoulder is snugly tightened against the end of said block, said enlarged shank being rotatable within said hole in said vertical member.

6. In the apparatus of claim 4, wherein said tubular frame member has a slotted hole therein extending from near one end of said frame member to near the other end thereof, and said releasable securing means includes a tightener bolt having an elongated plate threadedly screwed thereon with said plate snugly tightened against the head of said bolt, said bolt extending from the inside of said frame member radially outward through said slotted hole and through a first hole provided therefore in said cross member of said support, and having a nut screwed onto the leading end of said bolt over said cross member, and a pin extending upwardly from one end of said elongated plate through said slotted hole and into a second hole in said cross member a spaced distance from said first hole, said plate being wide enough to span the width of said slotted hole.

7. In the apparatus of claim 6, including an elongated rib extending longitudinally along the bottom surface of said cross member in each of said supports and protruding downwardly into said slotted hole to maintain said support in proper alignment with the other support, press means, and indicator means.

8. The apparatus of claim 4, wherein said supports are adjustable to respective positions six and one half inches on either side of said deflection indicator means and thirteen inches apart from each other, and includes a weighted body having suspension means thereon for hanging said weighted body on the shaft of an arrow being supported by said bearing surfaces and retention means attachable to one of said supports for spacing and retaining said weighted body in suspension a distance of thirteen inches outward from the bearing surface of said one support on the side opposite said one support from said other support.

9. The apparatus of claim 8, including a fixed scale positioned on said frame and an indicator on each of said supports, said scale being graduated to indicate distance of said bearing surfaces from said deflection indicator.

10. In arrow straightener apparatus having a pair of arrow supports in spaced-apart relation to each other, press means positioned between said supports for applying a transversely directed pressure on an arrow positioned on said supports, and deflection indicator means in proximity to said press for measuring and indicating the deviation of an arrow shaft from its normally straight longitudinal axis, said deflection indicator means including an elongated axially extendable and retractable feeler shaft positioned such that its distal end contacts the arrow shaft, the improvement comprising:

said press means including a pressure applying surface for contacting the arrow shaft and applying straightening pressure thereon, said pressure applying surface being positioned in concentric surrounding relation to said feeler shaft, said pressure applying surface and said feeler shaft being movable independent of each other.

11. The apparatus of claim 10, said press means including a horizontal arm extending transversely over the position occupied by an arrow shaft on said supports and having a vertical hole therethrough, said feeler shaft extending vertically through said hole, and drive means for moving said arm downward to apply straightening pressure to the arrow shaft.

12. The apparatus of claim 11, including an elongated tubular frame, said supports being adjustably mounted on said frame, an elongated vertical shaft affixed to said frame and extending upwardly therefrom, a sleeve slidably mounted on said vertical shaft, said horizontal arm being affixed to and extending radially from said sleeve, and said drive means including a horizontal drive shaft journaled in said frame, a reel mounted on and keyed to said drive shaft, a flexible cable attached at one end to said horizontal arm and at the other end to said reel, a radial handle keyed to and extending from said drive shaft for manually turning said shaft to wind said cable around said reel to pull said horizontal arm downwardly, bias means connected to said sleeve and said vertical shaft for biasing said horizontal arm upwardly away from said reel, and limit stop means connected to said drive shaft for limiting the extent to which said bias means can impart upward motion to said horizontal shaft.

13. Arrow straightener and test apparatus, comprising:

an elongated frame member;

two support means on opposite ends of said frame member for supporting opposite ends of an arrow thereon, said support means being adjustably mounted to move respectively toward and away from each other and each support means including a bearing surface on which the arrow is positioned for support, said bearing surface being mounted to swivel about an axis transverse to said frame member and to an arrow properly positioned on said supports;

press means positioned between said support means for applying transverse pressure on the shaft of the arrow for straightening, said press means including a vertical guide shaft affixed to and extending upwardly from said frame member, a guide sleeve slidably positioned around said shaft, a horizontal press arm affixed to and extending radially from said sleeve transverse to said frame to a position over the location of the arrow shaft when properly positioned on said support means, a load applying surface on the bottom of said press arm near its distal end in alignment with the location of the arrow shaft, and drive means connected to said press arm for forcing downwardly to apply straightening pressure on said arrow; and measuring means for measuring and indicating the deflection of the arrow shaft from a straight longitudinal axis, said measuring means including feeler means positioned at the axial center of said load applying surface in continuous contact with the arrow shaft for detecting the position of said shaft at the location where the straightening pressure is applied, and indicator means for transforming the arrow shaft position detected by said feeler means into a visual display for accurate perception by the operator of the apparatus.

14. The apparatus of claim 13, wherein said press arm has a hole extending therethrough and through the center of said load applying surface normal to the longitudinal axis of the arrow, and said feeler means includes an elongated feeler shaft connected to said indicator means with its distal end extending through said hole into contact with the arrow shaft, said feeler shaft and said press arm being movable independent of each other.

15. The apparatus of claim 14, wherein said drive means includes a drive shaft journaled in said frame member, a reel mounted on and keyed to said drive shaft, a flexible cable with one end connected to said press arm and the other end wrapped around and connected to said reel, bias means connected to said press arm for biasing said press arm away from the arrow shaft, and handle means connected to said drive shaft for rotating said drive shaft to wind said cable onto said reel and pull said press arm toward and into contact with said arrow shaft and applying straightening pressure thereon.

16. The apparatus of claim 15, wherein said handle means includes an enlarged hub mounted on and keyed to said drive shaft adjacent said frame member, an elongated lever extending radially outward from said hub for grasping manually to rotate said drive shaft forwardly, and a notch on the inside lateral surface of said hub, and said apparatus includes a rigid finger extending outwardly from said frame into alignment with said notch to limit the rearward rotation of said drive shaft thereby limiting the extent to which said bias means can retract said press arm away from the arrow shaft.

17. The apparatus of claim 13, wherein said bearing surface in each of said support means is comprised of the peripheral surfaces of a pair of circular wheels rotatably mounted in closely spaced adjacent tandem relation to each other in a mounting block, and each of said support means also includes two spaced apart vertical plates extending upwardly from opposite sides of a cross plate which is slidably positioned on said frame member, said mounting block being rotably suspended between said vertical plates on an axle extending from one side of said block through one of said vertical plates and another axle extending from the opposite side of said block through the other of said vertical plates.

18. The apparatus of claim 17, wherein one of said blocks is rotatable to a position where said bearing surface is upside down such that an arrow can be positioned with its shaft over the other of said bearing surfaces and under said one bearing surface, and said apparatus also includes a weighted body of a standard predetermined weight having means for suspending said weighted body from the arrow shaft, means for spacing and retaining said weighted body a standard pre-determined distance from said other bearing surface, and means for measuring and setting said bearing surfaces respectively standard pre-determined distances on opposite sides of said measuring means for testing and determining the spine strength of the arrow.

19. Straightener apparatus for straightening an elongated shaft, comprising:

press means adapted to apply a force on the shaft in a direction substantially normal to the longitudinal axis of the shaft; and a pair of shaft supports in axially spaced-apart relation to each other positioned on opposite sides of said press means, each of said supports including a bearing surface adapted for supporting the shaft during straightening operations, and swivel mounting means for mounting said bearing surface in said support in a manner whereby said bearing surface is adapted to swivel about an axis which is positioned to intersect at substantially a right angle a portion of the shaft supported on said bearing surface.

* * * * *

UNITED STATES PATENT AND TRADEMARK OFFICE

CERTIFICATE OF CORRECTION

PATENT NO. : 4,203,308

DATED : May 20, 1980

INVENTOR(S) : Duane L. Davis

It is certified that error appears in the above—identified patent and that said Letters Patent is hereby corrected as shown below:

Column 11, line 11, "claim 3" should read -- claim 2 --.

Signed and Sealed this

*Fifth* Day of *August 1980*

[SEAL]

*Attest:*

SIDNEY A. DIAMOND

*Attesting Officer*

*Commissioner of Patents and Trademarks*